US006837738B1

(12) United States Patent
Chen

(10) Patent No.: US 6,837,738 B1
(45) Date of Patent: Jan. 4, 2005

(54) FAST ELECTRIC CONNECTOR PLUG

(75) Inventor: Michael Chen, Keelung (TW)

(73) Assignee: Surtec Industries, Inc., Taiwan (CH)

( * ) Notice: Subject to any disclaimer, the term of this patent is extended or adjusted under 35 U.S.C. 154(b) by 19 days.

(21) Appl. No.: 10/464,779

(22) Filed: Jun. 19, 2003

(51) Int. Cl.[7] ..... H01R 11/20
(52) U.S. Cl. ..... 439/418; 439/941
(58) Field of Search ..... 439/418, 941, 439/676, 695, 687, 901, 906, 460, 904, 344

(56) References Cited

U.S. PATENT DOCUMENTS 5,571,035 A * 11/1996 Ferrill ..... 439/894
5,830,005 A * 11/1998 Watanabe ..... 439/418
5,888,100 A * 3/1999 Bofill et al. ..... 439/676
5,899,770 A * 5/1999 Ezawa ..... 439/418
5,967,801 A * 10/1999 Martin et al. ..... 439/76.1
6,280,232 B1 * 8/2001 Beecher et al. ..... 439/418
6,439,920 B1 * 8/2002 Chen ..... 439/418

* cited by examiner

*Primary Examiner*—Tho D. Ta
*Assistant Examiner*—Edwin A. Leon
(74) *Attorney, Agent, or Firm*—Harness, Dickey & Pierce, P.L.C.

(57) ABSTRACT

A fast electric connector plug that produces noise within the median value of the category 6 (CAT-6) standard. Through an insertion element installed inside an electric connector plug, four twisted pairs of a CAT-6 cable are configured in four directions from the same central point. At the same time, the first twisted pair is kept twisted and the other three twisted pairs are parallel before reaching the contacts of the plug. The first wire and the eighth wire are kept close to the third wire and the sixth wire in order to produce a compensation effect and achieve more reliable fast data transmissions.

14 Claims, 11 Drawing Sheets

FAST ELECTRIC CONNECTOR PLUG

BACKGROUND OF THE INVENTION

1. Field of Invention

The invention relates to an electric connector plug and, in particular, to a fast electric connector plug that generates noise within the median value of the category 6 standard.

2. Related Art

In response to future network applications in the Ethernet, the U.S. Telecommunications industry Associations (TIA) released a CAT-6 standard (ANSI/TIA/EIA-568-B.2-1) in June 2000. The CAT-6 standard is expanded from 100 MHz of the CAT-5 standard to 200 MHz. Its capacity is also higher than that of CAT-5 by 25%. Therefore, the test frequency for CAT-6 cables may even reach 250 MHz. The biggest difference between CAT-6 and CAT-5 is the improvement in cross-talks and return losses. For new generation full duplex fast network applications, fewer return losses are very important. The cross-talk is a key factor for the best bandwidth. Although 100 Mbps is still the mainstream in current network setups, the CAT-6 standard will be more suitable for future needs.

The above-mentioned standard does not only apply to fast communication cables. To maintain the same fast transmission speed in fast communication network systems, related peripheral devices of fast communication cables, particularly electric connectors (such as RJ-45 plugs and jacks), have to have corresponding designs. The connector commonly used in fast communication networks is the RJ-45 connector (including plugs and jacks). The normal RJ-45 connector is 8P8C, where 8P means 8 positions and 8C means 8 gold-plated contacts. In practice, only two pairs are really used and the other two pairs are saved for telephone lines or fax machines. The pins in EIA/TIA-568B, from 1 to 8, are covered by the following colors: white-orange, orange, white-green, blue, white-blue, green, white-brown, and brown, respectively.

In pending U.S. patent application Ser. No. 10/216,215 a fast electric connector plug with the category 6 (CAT-6) standard is disclosed. Through an insertion element installed inside an electric connector plug, the invention configures four twisted pairs of a CAT-6 cable in four directions from the same central point. At the same time, the position of each twisted pair is kept non-twisted and parallel before it reaches the contacts of the plug. The wire positions can be kept close to one another, producing compensation effects to achieve more reliable fast data transmissions. After production and testing, this can satisfy the category 6 standard. However, the noise produced is near the critical values of the standard ranges. It is hard to control its quality due to the inaccuracy of manufacturing.

SUMMARY OF THE INVENTION

An objective of the invention is to improve the structure of conventional plugs and provide a fast transmission electric connector plug that produces noise within the median value of the category 6 standard.

The invention uses an insertion element that can be put into an electric connector plug. This insertion element has several guide channels, which are distributed in four directions relative to the same central point. Each twisted pair of the fast communication cable is connected to the contacts at the front end of the plug under the guidance of the corresponding guide channel. The cross section of each guide channel is a long hole for a first twisted pair to pass through twisting and the other three twisted pairs to pass through in parallel. In this manner, the wire positions can be readily controlled. Besides, by closing the first wire to the eighth wire and the third wire to the sixth wire for creating compensation, the noise between the wires is kept within the median value of the category 6 standard.

To achieve the above objectives, the insertion element of the invention has two parts, including a carrier and a cover. The carrier and the cover tightly hold the fast communication cable before each twisted pair and the insertion element are installed inside the plug. This can prevent the end of any cable from being displaced due to friction in the assembly process, resulting in incorrect connections with the contacts.

DETAILED DESCRIPTION OF THE INVENTION

Figure 1:
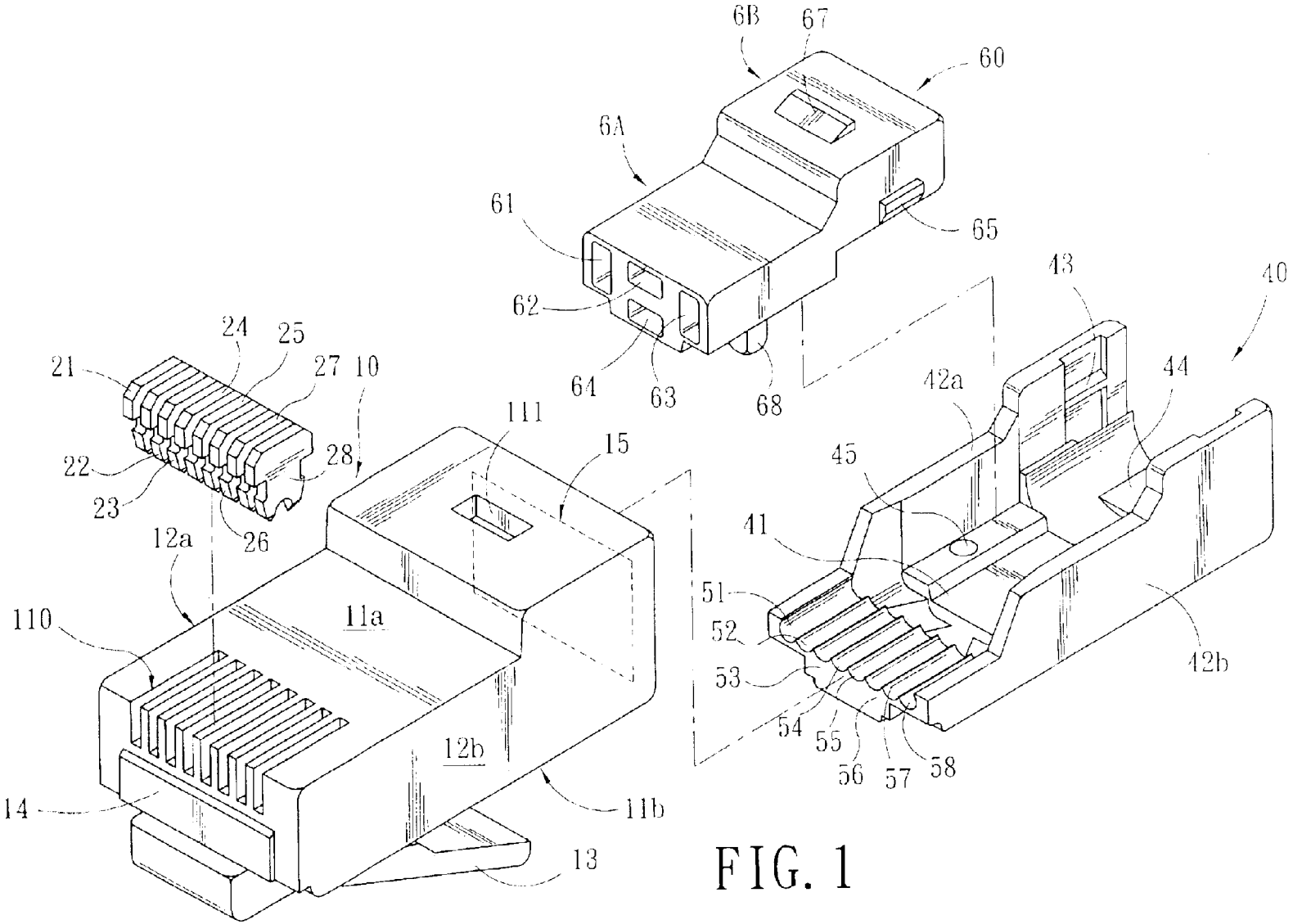
FIG. 1 is an exploded view of the structure of the invention.
Figure 4:
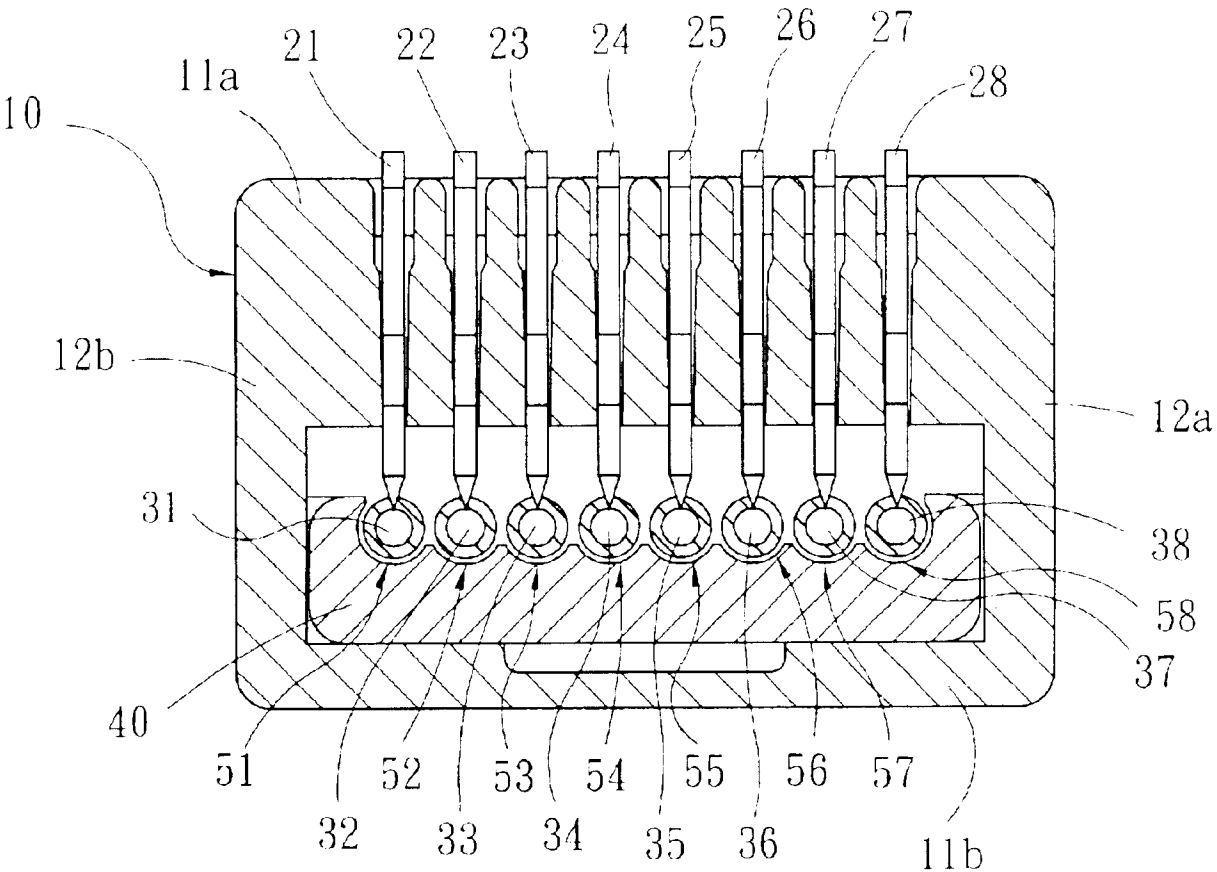
FIG. 4 is a cross-sectional view of FIG. 3 at the IV—IV position, showing the contact relation between the metal electrodes and the twisted pairs.

Please refer to FIG. 1. The disclosed electric connector plug has a plug shell 10 and an insertion element. The plug shell 10 is the same size as an RJ-45 electric connector plug. It is a hollow element with an upper wall 11*a*, a lower wall 11*b*, a left wall 12*a*, a right wall 12*b*, and an elastic chip 13 located at the bottom of the lower wall 11*b* and extending downwards. The elastic chip 13 is used to hold and connect with an electric connector jack (not shown). The front end in the insertion direction toward the electric connector jack is a closed front wall 14. The other end is an opening 15 to the exterior. The front end of the plug shell 10 has eight metal electrodes 21~28. The metal electrodes 21~28 are inserted from the insertion holes 110 at the front end of the upper wall 11*a* downward into the plug shell 10. They are connected with the twisted pairs 31~38 of the fast communication cable 30 through the sharp front ends of the metal electrode 21~28. The metal electrodes 21~28 are of the same length (see FIG. 4).

The insertion element is inserted into the plug shell 10 through the opening 15 along the same installation direction of the plug shell 10. It has a carrier 40 and a cover 60. The carrier 40 is a narrow and long element. It has a bottom part 41, a left wall 42*a*, and a right wall 42*b*. Several wire slots 51~58 at the bottom part 41 near the front end of the plug shell 10 extend forward. These wire slots 51~58 are underneath eight metal electrodes 21~28 for supporting different twisted pairs 31~38. The front end of each metal electrode 21~28 can prick through the insulating coat of the corresponding wires 31~38, resulting in electrical communication with the wires.

Figure 2:
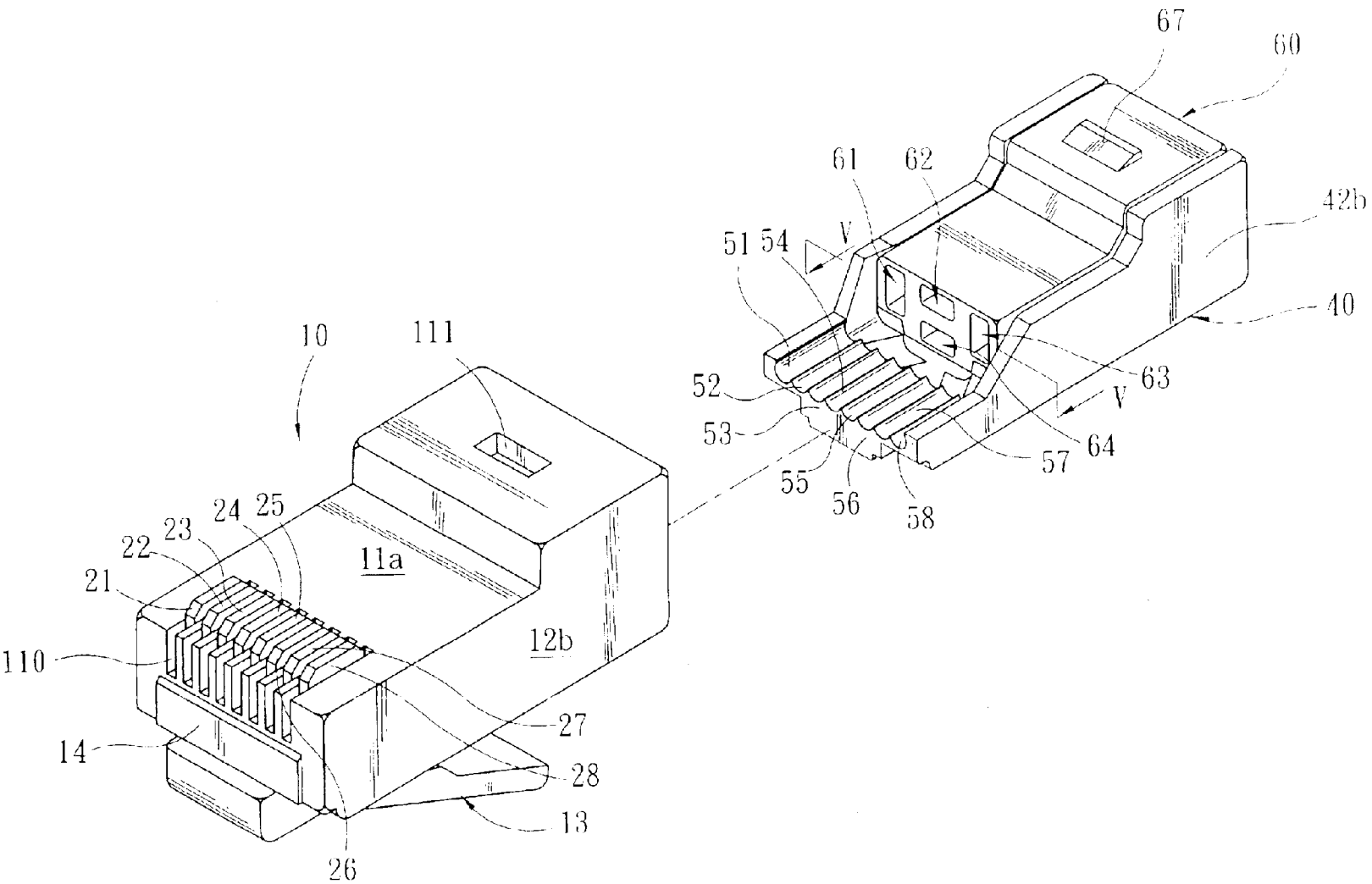
FIG. 2 demonstrates the structure of the invention, showing how the carrier and the cover are combined, and the direction in which the combined insertion element are plugged into the plug shell.
Figure 3:
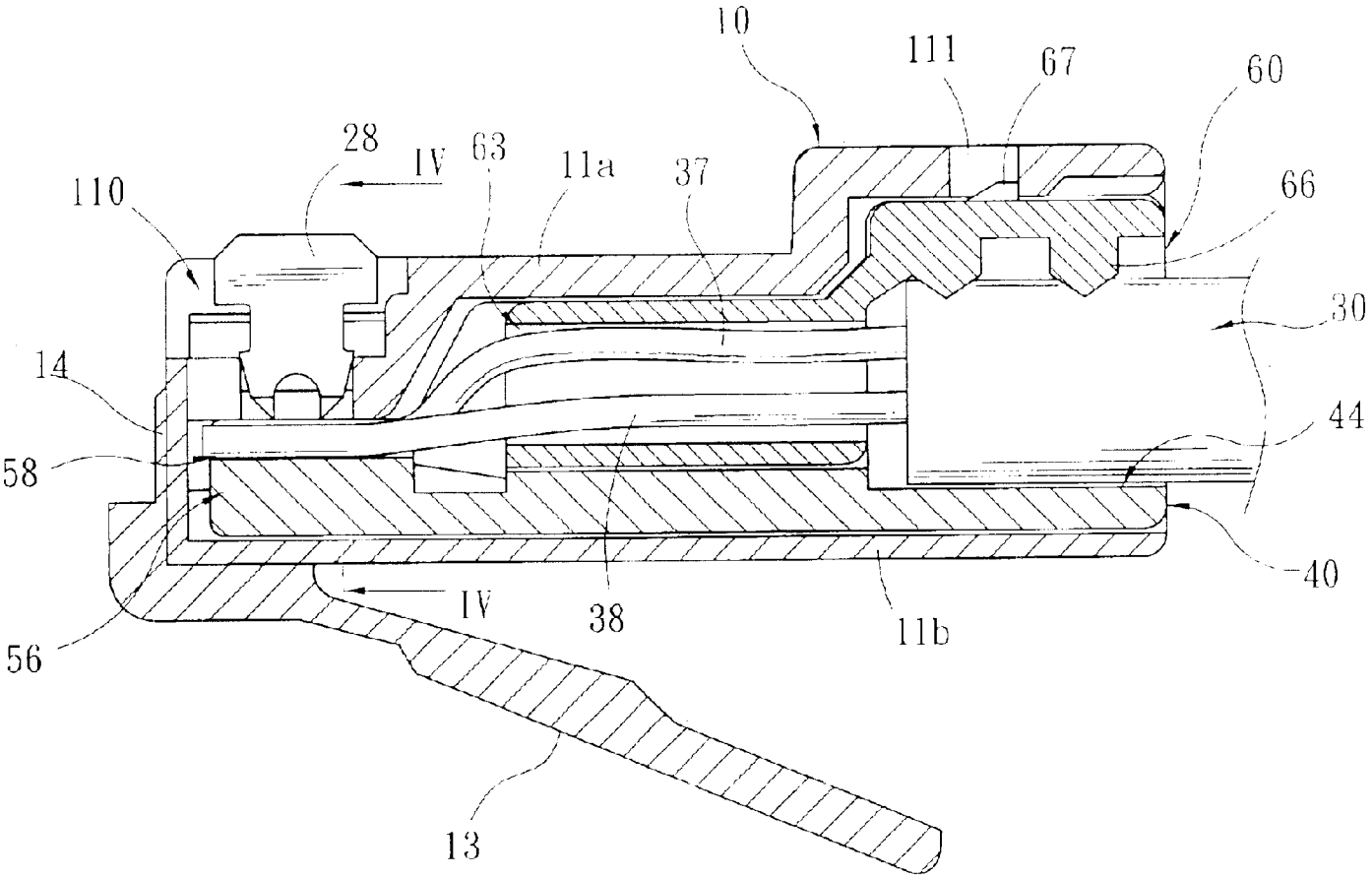
FIG. 3 is a cross-sectional view of the disclosed structure, showing the cross section of the electric connector plug, the assembly of the fast communication cable and the insertion element.

The cover 60 is also a narrow and long element. It can be installed in the space enclosed by the bottom part 41, the left wall 42*a*, and the right wall 42*b* of the carrier 40 (see FIG. 2). The cover 60 can be divided into a front section 6A and a rear section 6B along its axial direction. Four guide channels 61~64 penetrate through the front section 6A for guiding the four twisted pairs (Pair 1~4) of the fast communication cable 30. The forth wire 34 and the fifth wire 35 form pair 1, the first wire 31 and the second wire 32 form pair 2, the third wire 33 and the sixth wire 36 form pair 3, and the seventh wire 37 and the eighth wire 38 form pair 4. The guide channels 61~64 are long holes (with a rectangular or circular cross section). The four twisted pairs 31&32, 33&36, 34&35, 37&38 (Pair 1~4) go through the guide channels 61~64 and the first twisted pair 34&35 passes through twisting and the other three twisted pairs 31&32, 34&35, 37&38 pass through in parallel. The rear section 6B has several connecting elements 65 (such as hooks) installed on the two walls 42*a*, 42*b* for connecting with the connecting parts 43 (such as hook holes) formed on the left wall 42*a* and the right wall 42*b* of the carrier 40, thereby combining the cover 60 and the carrier 40. The cover also has several protruding wire holding saws 66 on the surface facing the carrier 40. A wire holding surface 44 is formed at the corresponding position on the bottom part 41 of the carrier 40. After the cover 60 and the carrier 40 are combined together, the fast communication cable 30 is tightly held between the cover 60 and the carrier 40 (see FIG. 3).

Figure 5:
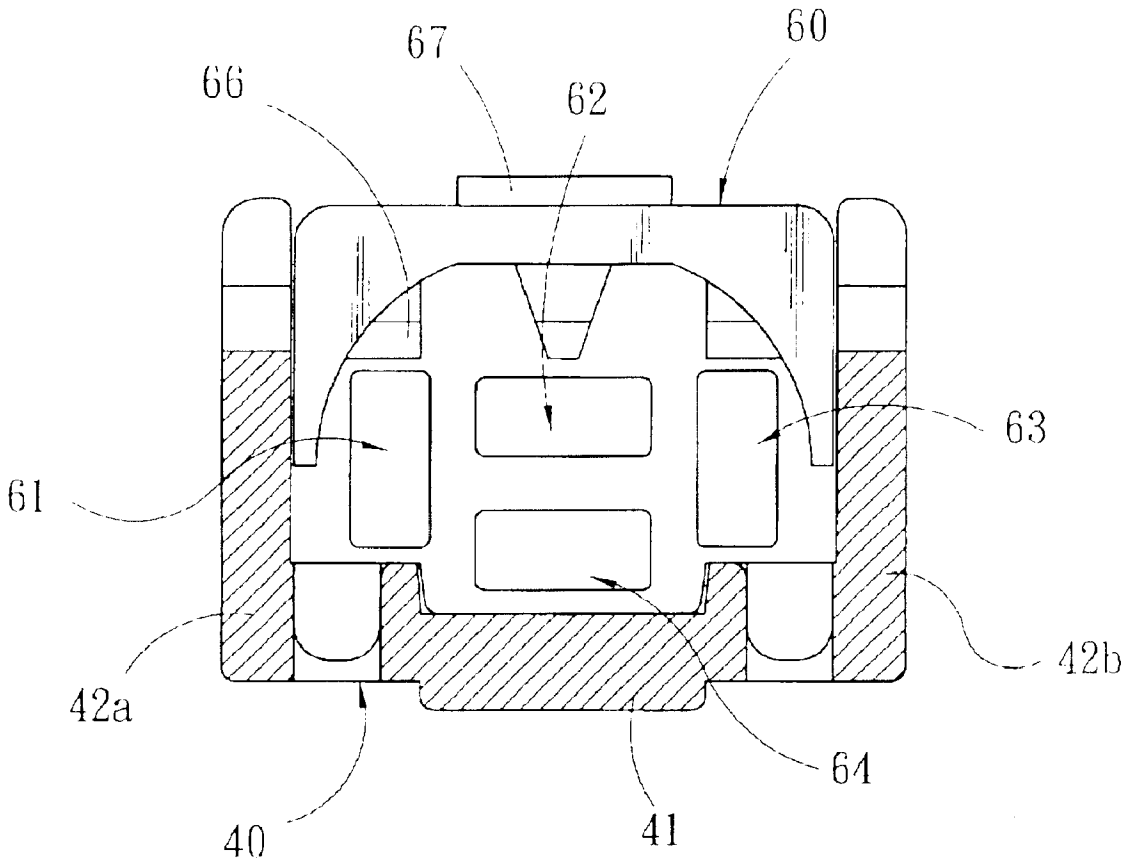
FIG. 5 is a cross-sectional view of FIG. 2 at the V—V position, showing the positions of the guide channels after the cover and the carrier are combined together.
Figure 8:
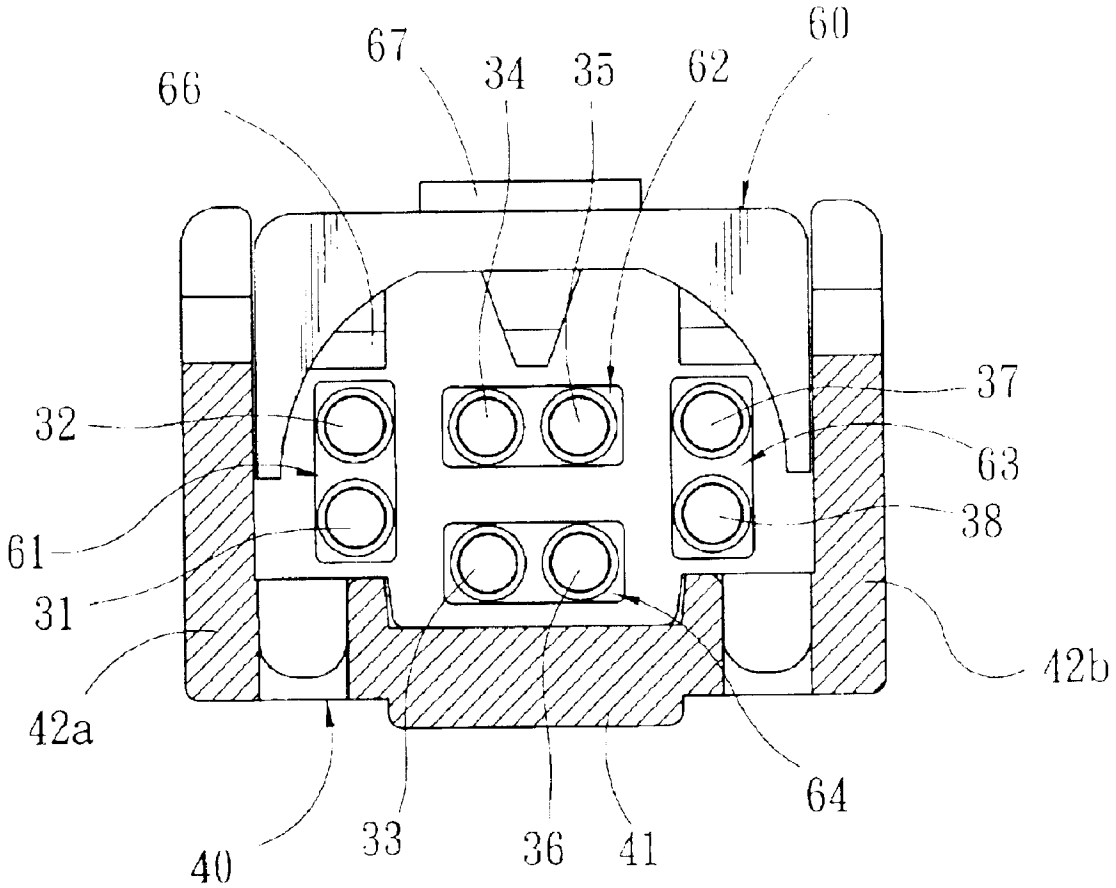
FIG. 8 is a cross-sectional view of FIG. 2 at the V—V position, showing the positions of each wire in the guide channels.

In principle, the guide channels 61~64 are long holes and have to be formed in four directions around the same central point. As shown in FIG. 5, the guide channels 61 and 63 are on the left and right sides, whereas the guide channels 62 and 64 are on the upper and lower sides. The four twisted pairs 31~38 then go through the guide channels 61~64. The first twisted pair 34&35 passes through twisting and the other three twisted pairs 31&32,34&35,37&38 pass through in parallel (see FIG. 6). It is preferable that the first twisted pair 34&35 twists exactly one time. Since the twisted pairs 31~33 and 36~38 in this section are parallel with each other and non-twisted, the wire positions after the guide channels 61~64 can be properly controlled to obtain compensation for the TT and TR effects. As shown in FIG. 8, the first wire 31 is designed to be closer to the third wire 33, and the eighth wire 38 is designed to be closer to the sixth wire 36 in order to produce the TR compensation effect.

Figure 9:
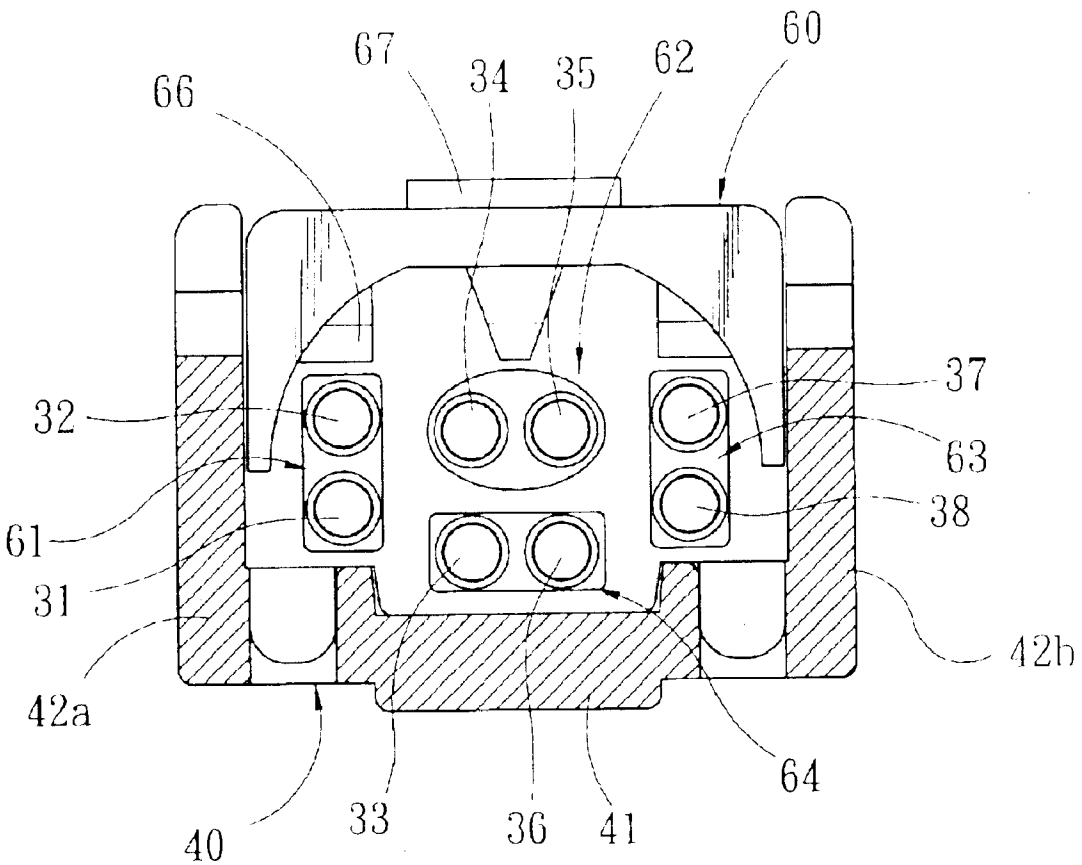
FIG. 9 is another embodiment of the guide channel configuration.
Figure 11:
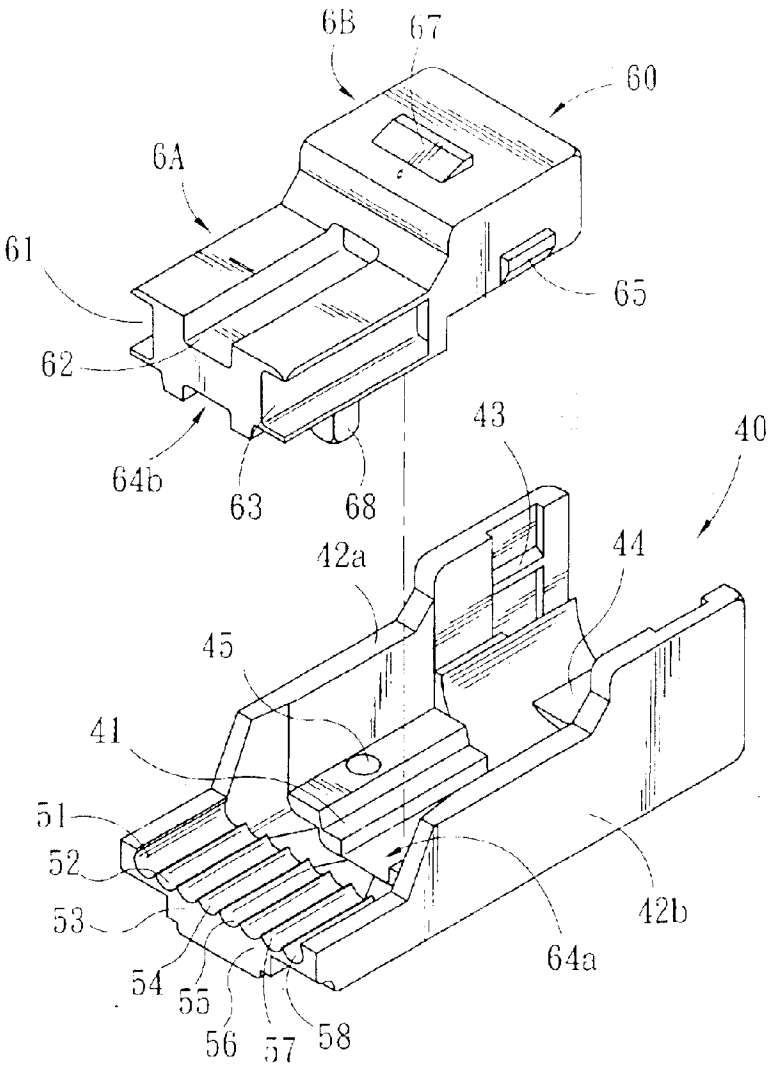
FIG. 11 is a schematic view of the disclosed guide slots.

The first twisted pair 34&35 is set higher than the third twisted pair 33&36, though this can be reversed. On the other hand, the guide channels 61~63 are on the same level, but the guide channel 64 is at a different level (see FIG. 9). The guide channels 61~64 are still long, oval-shaped holes in the cross-section. With reference to FIG. 11, the guide channel 64 can be also formed using a lower guide slot 64*a* in the middle section of the bottom part 41 of the carrier and an upper guide slot 64*b* at the center of the bottom surface of the front section 6A of the cover 60.

Figure 6:
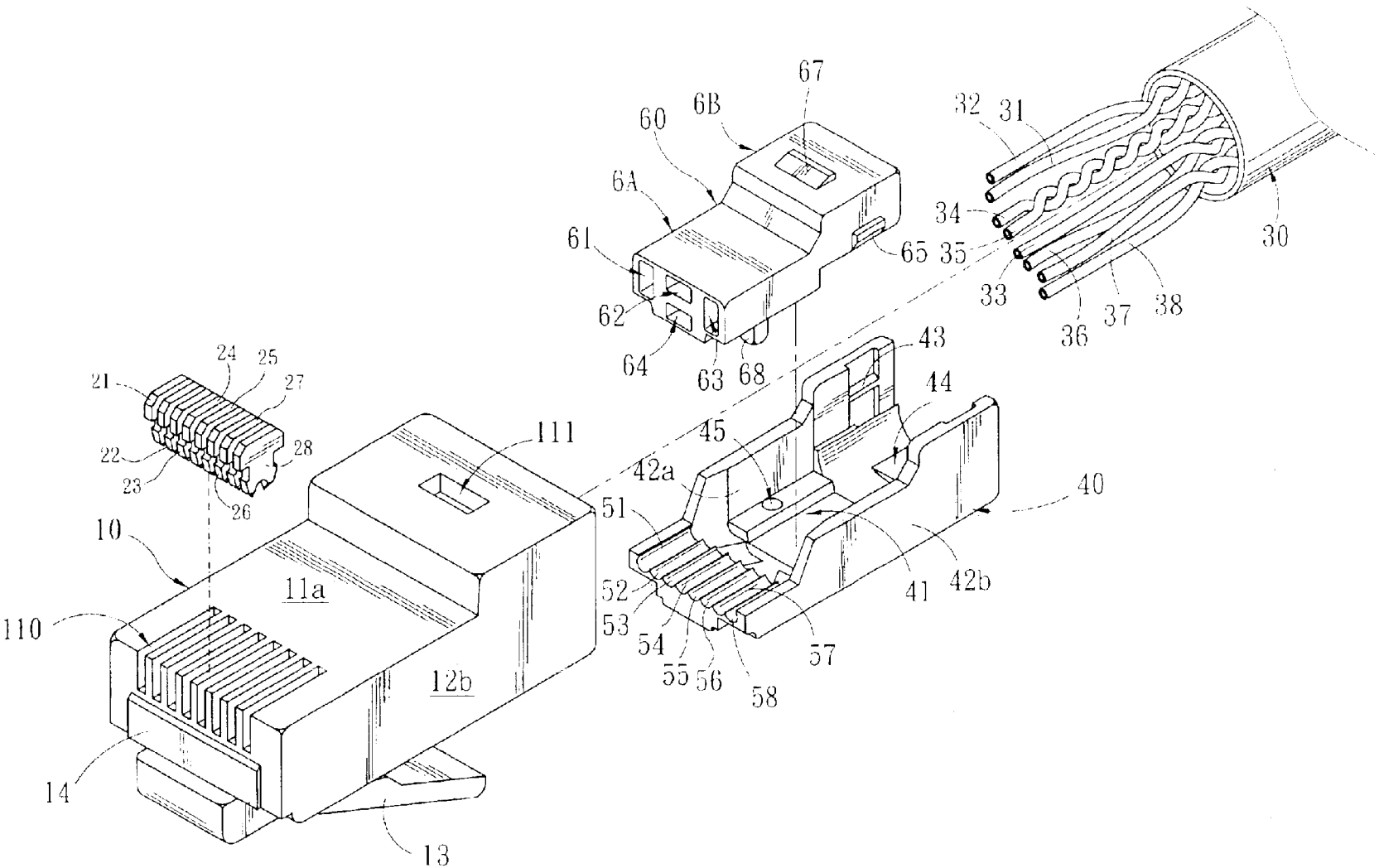
FIG. 6 is a schematic view showing how the fast communication cable and the insertion element are assembled.

With further reference to FIG. 6, when the electronic connector plug and the fast communication cable 30 are connected together, the cover layer of the fast communication cable 30 is first peeled. The four twisted pairs 31~38 (Pair 1~4) inside the fast communication cable are taken out and the twisted wires are untangled. Afterwards, the first twisted pair 34&35 is inserted twisting and the other three twisted pairs 31~33, 36~38 are inserted in parallel through the guide channels 61~64 of the insertion element (see FIG. 3). As shown in the drawing, the first and third twisted pairs 33~36 are in parallel on the same horizontal plane and the second and fourth twisted pairs 31, 32, 37, 38 are in parallel on the same vertical plane. The insulating cover layer of the fast communication cable 30 is placed as close as possible between the wire holding saws 66 of the cover 60 and the wire holding surface 44 of the carrier 40. The cover 60 and the carrier 40 are combined in such a way that the connecting elements 65 on both sides of the cover 60 and the connecting parts 43 of the carrier 40 are coupled. At the same time, the fact communication cable is tightly held between the cover 60 and the carrier 40.

Figure 7:
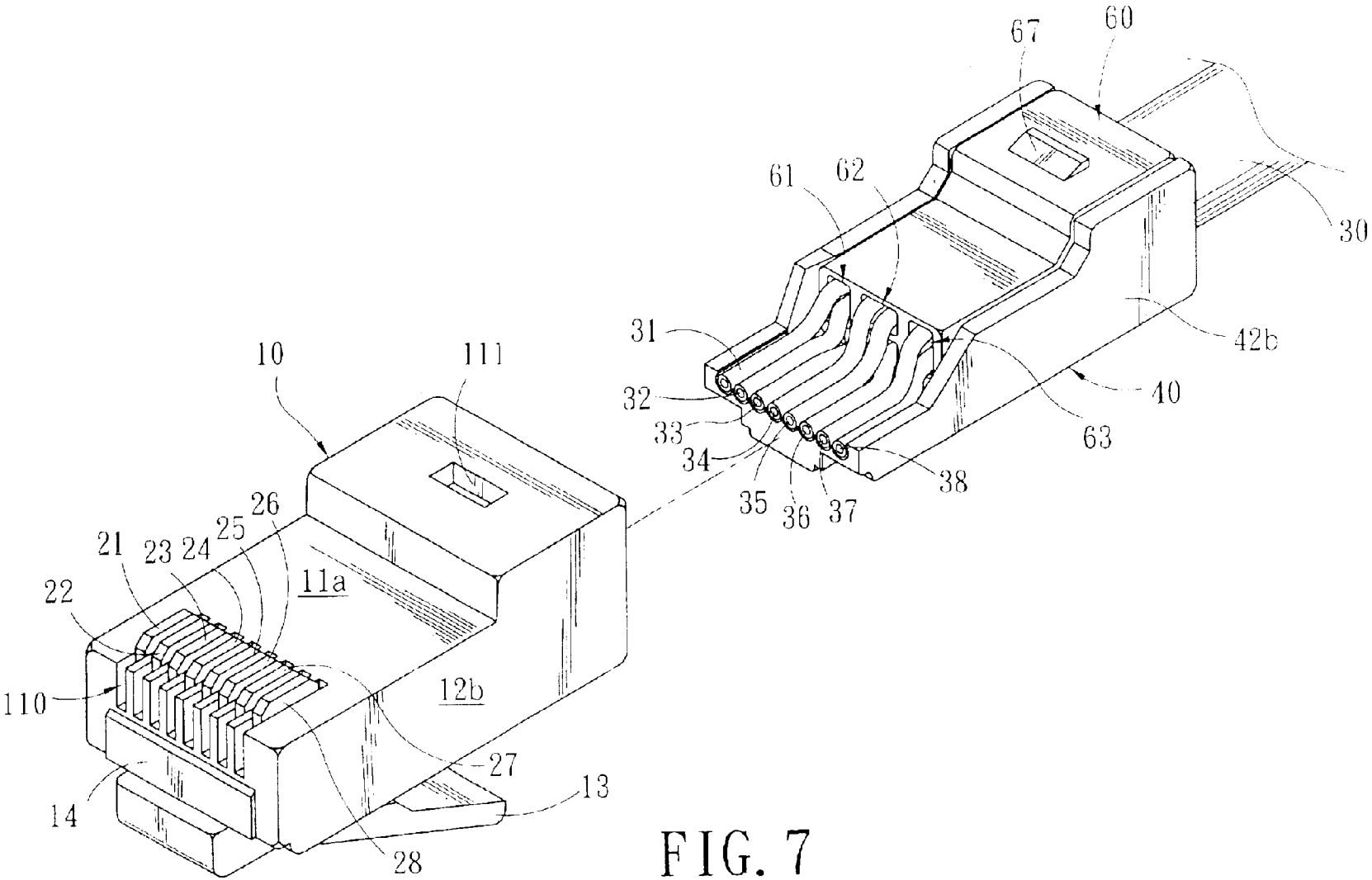
FIG. 7 is a schematic view showing the position of the wire of each twisted pair in the wire slots after the fast communication cable and the insertion element are combined.

It should be emphasized that one has to make sure that the four twisted pairs 31~38 have to extend out a certain length after penetrating through the four guide channels 61~64 before the cover 60 and the carrier 40 are combined. The ends of the four twisted pairs 31~38 extend into the wire slots 51~58. The insertion element holding the fast communication cable 30 is then inserted into the plug shell 10 from its rear opening 15 (see FIG. 7), until a hook 67 on the top surface of the rear section 6B of the cover 60 catches a hook hole 111 on the top wall 11*a* of the plug shell 10. Finally, the metal electrodes 21~28 are plugged into the insertion holes 110 at the front end of the plug shell 10. In this way, the sharp tips of the metal electrodes 21~28 can make electrical contact with the twisted pairs 31~38 of the fast communication cable 30.

The wire slots 51~58 on the carrier 40 have a cross section with an upward opening. The width of the opening can be slightly smaller than the outer diameter of a single wire of the twisted pair 31~38. When the cover 60 and the carrier 40 are combined together, one can directly put the four twisted pairs 31~38 through along the axial direction of the wire slots 51~58. Alternatively, one can also straighten these twisted pairs 31~38 and push them downward through the narrow opening of the wire slots 51~58.

Figure 10:
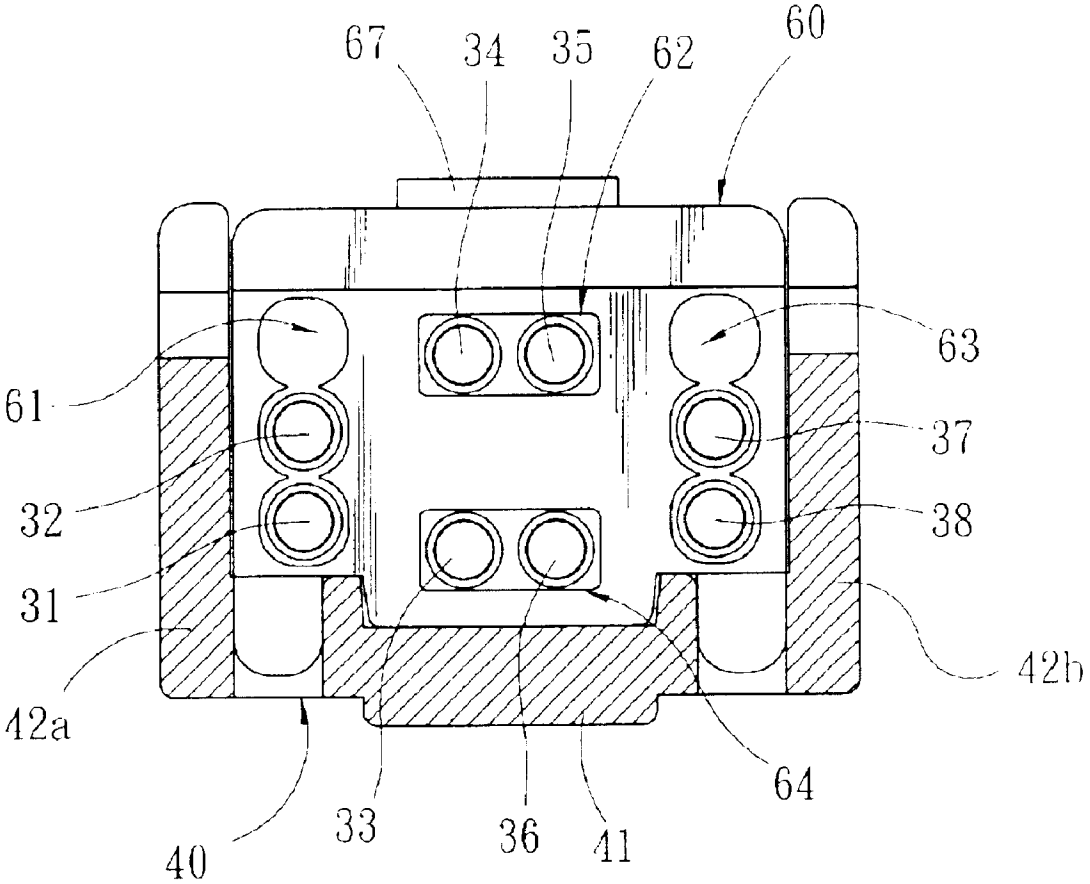
FIG. 10 is a schematic view of a single guide slot providing three wire positions.

On the other hand, some fast communication cables have different specifications for the communication connectors on both ends, such as 568A and 568B. In some special cases, one may need to have jumps. To satisfy such needs and to further enhance the compensation effect, the two guide channels 61~64 can have at least three position holes. With reference to FIG. 10, the guide channels 61 and 63 on the left and right sides have three position holes for the twisted pairs 31~38 to pass through. As shown in the drawing, three connected circular holes are formed to further limit the wire positions and their relative distances. This puts the first wire 31 closer to the third wire 33, and the eighth wire 38 closer to the sixth wire 36.

The two-piece design for the insertion element can tightly hold the fast communication cable before the twisted pairs and the insertion element are plugged into the plug shell, preventing improper connections between the cable and the metal electrodes during assembly.

The embodiments in the previous paragraphs are only examples of the disclosed technique. They should not be used to constrain the scope of the invention. Any person skilled in the art can readily make modifications and changes without departing from the spirit of the invention. For example, the two components of the insertion can be changed into a left-right combination.

What is claimed is:

1. A fast electric connector plug for assembly with a fast communication cable, said communication cable containing four twisted pairs, wherein the forth wire and the fifth wire defining a pair 1, the first wire and the second wire defining a pair 2, the third wire and the sixth wire defining a pair 3, and the seventh wire and the eighth wire defining a pair 4, comprising:

a plug shell, which is a hollow RJ-45 plug and has an opening on at least one end, and eight metal electrodes on its front end, the eight metal electrodes being inserted into the plug shell and in electrical communications with said four twisted pairs in the fast communication cable; and an insertion element, which is plugged into the plug shell from the opening thereof, and has a plurality of guide channels for guiding the four twisted pairs in the fast communication cable to connect with the metal electrodes, each guide channel being a long hole for said pair 1 to go through twisting and the other three pairs to go through in a parallel way and the guide channels controlling the first wire being closer to the eighth wire and the third wire being closer to the sixth wire for compensation.

2. The fast electric connector plug of claim 1, wherein said pair 1 twist for exactly one time when going through the guide channel.

3. The fast electric connector plug of claim 1, wherein the guide channels are penetrating holes forming on the insertion element.

4. The fast electric connector plug of claim 1, wherein the guide channels are formed by two slots on the plug shell and the insertion element.

5. The fast electric connector plug of claim 1, wherein the pair 3 and pair 1 of the fast communication cable go through the guide channels in the up and down directions.

6. The fast electric connector plug of claim 1, wherein the carrier has a plurality of wire slots extending forward near the front end of the plug shell and the wire slots are underneath the eight metal electrodes for supporting different twisted pairs at the same level.

7. The fast electric connector plug of claim 1, wherein the guide channel has a tube structure.

8. The fast electric connector plug of claim 1, wherein the guide channel has a groove structure.

9. The fast electric connector plug of claim 1, wherein one of the guide channels has at least three holes for the wires in the twisted pairs to pass through and the distance between the wires is controlled by their positions in the guide channel with at least three holes.

10. The fast electric connector plug of claim 9, wherein the guide channel opposite to the guide channel with at least three holes also has corresponding at least three holes for wires of the twisted pairs to pass through.

11. The fast electric connector plug of claim 1, wherein the insertion element further contains a carrier and a cover that couple with each other.

12. The fast electric connector plug of claim 11, wherein a plurality of protruding saws are formed on the surface of the cover that faces the fast communication cable so that the fast communication cable is tightly clinched between the cover and the carrier after they are combined together.

13. The fast electric connector plug of claim 11, wherein the carrier has a left wall and a right wall and the walls are formed with connecting parts for coupling with corresponding connecting parts on the cover.

14. The fast electric connector plug of claim 11, wherein the top surface of the cover has a hook for connection with a hook hole formed on the upper wall of the plug shell.

* * * * *